US005500252A

United States Patent [19]

Meelu

[11] Patent Number: 5,500,252

[45] Date of Patent: Mar. 19, 1996

[54] HIGH TEMPERATURE CORROSION RESISTANT COMPOSITE COATINGS

[75] Inventor: Mehar C. Meelu, Birmingham, England

[73] Assignee: Rolls-Royce plc, London, England

[21] Appl. No.: 438,733

[22] Filed: May 10, 1995

Related U.S. Application Data

[60] Division of Ser. No. 206,818, Mar. 7, 1994, which is a continuation-in-part of Ser. No. 112,985, Aug. 30, 1993, abandoned.

[30] Foreign Application Priority Data

Sep. 5, 1992 [GB] United Kingdom ..... 9218858

[51] Int. Cl.[6] ..... B05D 3/02

[52] U.S. Cl. ..... 427/376.3; 427/376.4; 427/376.6; 427/376.7; 427/376.8; 427/404; 427/405

[58] Field of Search ..... 427/376.3, 376.4, 427/376.6, 376.7, 376.8, 404, 405

[56] References Cited

U.S. PATENT DOCUMENTS

| | | | |
|---|---|---|---|
| 3,649,225 | 3/1972 | Simmons, Jr. | 29/194 |
| 3,677,789 | 7/1972 | Bungardt et al. | 117/22 |
| 3,819,338 | 6/1974 | Bungardt et al. | 29/194 |
| 3,874,901 | 4/1975 | Rairden, III | 428/652 |
| 3,979,273 | 9/1976 | Panzera | 204/192 |
| 3,999,956 | 12/1976 | Stueber et al. | 29/194 |
| 4,080,486 | 3/1978 | Walker et al. | 428/653 |
| 4,101,715 | 7/1978 | Rairden, III | 428/652 |
| 4,123,594 | 10/1978 | Chang | 428/651 |
| 4,145,481 | 3/1979 | Gupta et al. | 428/678 |
| 4,382,976 | 5/1985 | Restall . | |
| 4,477,538 | 10/1984 | Clarke et al. | 428/656 |
| 4,501,776 | 2/1985 | Shankar . | |
| 4,526,814 | 7/1985 | Shankar et al. | 427/253 |
| 4,897,315 | 1/1990 | Gupta et al. | 428/552 |
| 4,910,092 | 3/1990 | Olson et al. . | |
| 4,933,239 | 6/1990 | Olson et al. | 428/557 |
| 4,962,005 | 10/1990 | Alperine et al. | 428/670 |
| 5,141,821 | 8/1992 | Lugscheider et al. | 428/614 |

FOREIGN PATENT DOCUMENTS

| | | | |
|---|---|---|---|
| 2095700 | 6/1982 | United Kingdom | C22C 19/05 |

*Primary Examiner*—Benjamin Utech
*Attorney, Agent, or Firm*—Cushman Darby & Cushman

[57] ABSTRACT

A multiplex protective MCrAlY-based coating system for an M-based superalloy base material, where M is at least one of iron, cobalt and nickel, has a surface layer containing aluminides of platinum and the M constituent of the coating. There may be a single surface layer (FIG. 2) containing platinum modified aluminide, or alternatively a double surface layer (FIG. 3) in the form of a top layer containing platinum modified aluminide and a sub-surface layer containing aluminides substantially without platinum modification. The surface layer may also have extra chromium in solid solution in the M constituent of the coating, the chromium content in the surface layer of the coating being not more than about 40 wt. %, preferably 35 to 40 wt. %. The process for production of such a system involves deposition of an MCrAlY coating, optionally chrimizing it, and then aluminising and platinising it using appropriate amounts of platinum and appropriate heat treatments to obtain the desired variant of the coating system. Alternatively, to boost aluminium levels near the surface, the coating can be platinised immediately before it is aluminised.

6 Claims, 6 Drawing Sheets

HIGH TEMPERATURE CORROSION RESISTANT COMPOSITE COATINGS

CROSS REFERENCE TO RELATED APPLICATION

This application is a divisional of Ser. No. 08/206,313, filed Mar. 7, 1994, is a continuation-in-part of Ser. No. 08/112,985, filed Aug. 30, 1993, now abandoned.

FIELD OF THE INVENTION

The present invention relates to so-called "MCrAlY" overlay coating systems modified to enhance resistange of superalloy gas turbine components to high temperature oxidation and corrosion attack.

BACKGROUND OF THE INVENTION

The term "MCrAlY" is a shorthand way of referring to well known temperature and oxidation/corrosion resistant alloy systems comprising in general one or more of nickel, cobalt and iron as the major "M" constituent, together with chromium and aluminium in quite large amounts, plus (usually) a minor amount of yttrium or other rare earth element. In weight percentage terms, such alloys may be broadly defined as having the following compositions:

Cr - 10 to 50%

Al - 4 to 30%

Y - 0 to 3%

Fe/Co/Ni - balance.

For example, one well known alloy, used as the basis of the present work, has a nominal composition in weight percent of:

Cr - 25%

Al - 12%

Y - 0.5%

Co - balance

As mentioned above, these alloys are frequently used as protective coatings for superalloy components exposed to high temperatures in corrosive environments. In tests, we have found that the above CoCrAlY alloy, in the form of an overlay coating applied by an argon shrouded plasma spraying technique, has given satisfactory high temperature protection and mechanical properties for nickel based superalloys such as IN738. This superalloy is available from the International Nickel company, and has the nominal composition in weight percent of:

Cr-16%, Al-3.4%, Ti-3.4%, Co-8.5%, W-2.6%,

Mo-1.75%, Ta-1.75%, Cb-0.9%, Fe-0.5%, Si-0.3%,

Mn-0.2%, C-0.17%, Zr-0.1%, B-0.01%, Ni-Balance.

One problem with all protective coatings of this type, particularly in highly corrosive marine environments, is gradual degradation in service due to continued mobility of elements within the coatings and from the base material at the high operating temperatures of the turbines of gas turbine engines. Elements such as Mo,W,Ti,Ta, and Cr present within a superalloy such as IN738 migrate into the coating, thus reducing the basic mechanical properties of the superalloy. Furthermore, elements at the surface of the coatings, such as Al,Cr,Co,Ni,Ti, etc., are consumed during service by oxidation and sulphidation and therefore have to be replaced continuously to afford continued protection. Such replacement occurs by means of migration to the surface from the bulk of the coating and ultimately from the superalloy base material.

It is already known to improve the ability of MCrAlY protective coatings to resist high temperature oxidation and corrosion by aluminising them to produce an aluminide layer on top of the MCrAlY coating. In this context, "high temperature" means above about 750° C. For example, British patent GB 1457033 discloses nickel- or cobalt-based superalloy components coated as follows:

a) vapour deposited MCrAlY coating;

b) further vapour deposited coating of aluminium on top of the MCrAlY coating;

c) heat treatment of the duplex coated component to cause the inter-diffusion of the aluminium and the MCrAlY coatings.

Such coatings have been further improved upon by incorporating further refractory oxidation/corrosion resistant metallic elements such as platinum and hafnium into the outer aluminium coating and then diffusion heat treating the resulting duplex coating to produce an aluminide layer containing the refractory elements. For example, U.S. Pat. No. 4,123,594 discloses Fe,Co, and Ni based superalloy components which are coated as follows:

a) vapour deposited MCrAl(Y)-type first coating;

b) application of further coating containing aluminium and at least one of the elements Hf and Pt—specifically, Al-Hf coatings were applied by a pack coating process and an alternative Al-Hf-Pt coating was applied by sputtering of Pt onto the first coating, followed by application of an Al-Hf coating by a pack coating process;

c) heat treatment of the coated component to cause the inter-diffusion of the coatings, so producing a graded coating in which the outer portion consists of 10–30 wt. % Al and 2–5 wt. % Hf, with, in the case of the Pt-containing coating, 20–40 wt. % Pt.

This patent also mentions rhenium and palladium as possible constituents of the outer portions of the coatings as additions to, or substitutions for, platinum and hafnium.

The contents of the above prior patent specifications are hereby incorporated by reference and should be consulted for further and more complete details of the compositions and processes summarized above.

It should be noted that, at least to some extent, MCrAlY coatings do act as a barrier between the base material and any outer aluminide coating to limit migration of base material elements, particularly aluminium and chromium, during service.

We prefer to apply MCrAlY coatings by the argon shrouded plasma spray process as mentioned above, proprietary to Union Carbide Coatings Service Corporation, of Indianapolis, U.S.A. After spraying, the coatings can be aluminised, but must, of course, be heat treated to inter-diffuse them with the base material.

As a result of aluminising an existing MCrAlY coating, stable aluminides of the "M" constituent(s) of the MCrAlY coating are produced in the top layer of the resulting coating, such as nickel and/or cobalt aluminides, resulting in improved hot oxidation/corrosion resistance. In service, some of the Al component in the aluminides gradually migrates to the surface of, the coating, where it is converted to alumina ($Al_2O_3$), so producing a corrosion/oxidation resistant barrier. Nevertheless, this barrier is gradually eroded and is replaced by further oxidation of aluminium migrating from the aluminides below.

Ideally, the required extra Al to maintain the concentration of aluminides in the surface layers of the coating could be supplied from the MCrAlY inner portion of the coating. But in the case of MCrAlY alloys with aluminium concentrations near the lower end of the above-mentioned ranges (say, 4 to 20 wt. %, e.g., 12 wt. %, as in the specific example mentioned above), the Al content is insufficient for the migration mechanism to be able to continue to supply the deficient surface layers with Al for a lengthy period. Despite this, MCrAlY coatings with such relatively low aluminium contents are preferred because higher Al contents tend to make the coating brittle in service after the necessary diffusion heat treatment has been carried out.

Consequently, it is desired to improve the hot corrosion and oxidation performance of aluminised plasma-sprayed MCrAlY coatings in which the MCrAlY component of the coating has a relatively low Al content of 4 to 20 wt. % in the as-applied condition.

In addition to the hot oxidation/corrosion resistance referred to above, it is also desirable to improve the ability of MCrAlY coatings to resist low temperature oxidation and corrosion, "low temperature" in the present context meaning about 550°–750° C. This, of course, should be accomplished without any detrimental effect on the high temperature protection afforded by the coatings.

One known way of improving low temperature oxidation/corrosion resistance of any coating system is to increase the concentration of chromium, at least near the surface layer of the coating. Generally speaking, it has been found that low temperature oxidation/corrosion resistance improves as Cr concentration levels in the coating increase to about 40 wt. %, but that further increases above 40 wt. % are deleterious. The process of increasing the Cr content of an existing coating is called chrimizing, and is usually accomplished by known vapour or pack chrimizing methods, such as those marketed by Chromalloy Corporation.

Chromising improves low temperature oxidation/corrosion resistance of coating systems because Cr oxidises to form chromia, $Cr_2O_3$, which forms a protective oxide film at the coating surface. Unfortunately, chrimizing is ineffective to improve high temperature oxidation/corrosion resistance of coating systems. This is because $Cr_2O_3$ dissociates into Cr and gaseous $CrO_3$ at temperatures above about 750° C.

SUMMARY OF THE INVENTION

Accordingly, the present invention includes a process for providing an M-based superalloy base material, where M is at least one of iron, cobalt and nickel, with a graded multiplex protective coating system containing aluminides in and near its surface, the process comprising the steps of:

applying an alloy coating material of the MCrAlY type to the surface of the base material, the Al content of the coating material being in the range 4 to 20 wt. %;

optionally, chrimizing the MCrAlY-type coating to produce a coating with a chrimized top layer having extra chromium in solid solution in the M constituent of the coating, the chromium content in the surface layer of the MCrAlY-type coating after chrimizing preferably being not more than about 40 wt. %, most preferably 35 to 40 wt. %;

aluminising the coating resulting from the preceding utilized process step to produce a coating having a surface layer containing aluminides of the M constituent of the coating;

depositing a platinum layer onto the surface of the aluminised coating, and heat treating the resulting coating to diffuse the platinum layer into the underlying aluminide containing layer, thereby to produce an MCrAlY coating having a platinum modified aluminide surface layer.

Preferably, the platinum layer has a thickness of 5 to 15 μm when applied, and the subsequent diffusing heat treatment is conveniently that normally utilized to restore the properties of the base material after the aluminising step. In the case of alloy IN738, this is one hour diffusion treatment at 1120° C. gas fan quench, and age 24 hours at 845° C.

Given the above heat treatment time, the thickness of the platinum layer as deposited is very important to the final structure of the above coating. Utilizing a deposited platinum layer having a thickness of 10 to 15 μm gives a structure comprising an MCrAlY coating having a single surface layer containing platinum modified aluminide. This is achieved because during heat treatment the platinum and the underlying aluminides inter-diffuse completely.

Alternatively, to obtain a structure comprising an MCrAlY coating having a double surface layer in the form of a top layer containing platinum modified aluminide and a sub-surface layer containing aluminides substantially without platinum modification, the deposited platinum layer should have a thickness of 5 to 10 μm. This can be achieved because during heat treatment the platinum and the underlying aluminides do not inter-diffuse completely.

The present invention also includes an alternative process for providing an M-based superalloy base material, where M is at least one of iron, cobalt and nickel, with a graded multiplex protective coating system containing aluminides with enhanced aluminium content in and near its surface, the process comprising the steps of:

applying an alloy coating material of the MCrAlY type to the surface of the base material, the Al content of the coating material being in the range 4 to 20 wt. %;

optionally, chrimizing the MCrAlY-type coating to produce a coating with a chrimized top layer having extra chromium in solid solution in the M constituent of the coating, the chromium content in the surface layer of the MCrAlY-type coating after chrimizing preferably being not more than about 40 wt. %, most preferably 35 to 40 wt. %;

depositing a platinum layer onto the surface of the coating resulting from the preceding utilized process step, heat treating the resulting coating to diffuse the platinum layer into the underlying MCrAlY coating, and aluminising the coating resulting from the preceding step and heat treating to diffuse the aluminium into the surface of the platinised coating, thereby to produce an MCrAlY coating having a surface layer containing platinum modified aluminides of the M constituent of the coating.

Preferably, the platinum layer has a thickness of 5 to 10 μm when applied.

The time of aluminising is very important to the final structure of the above coating. Utilizing a deposited platinum layer of the above thickness, to obtain a structure comprising an MCrAlY coating having a single surface layer containing platinum modified aluminide, the platinised coating should be aluminised only for a relatively short time of about 4 to 6 hours at the aluminising temperature. This will allow the aluminium to diffuse into the platinised coating only about as far as the platinum has already diffused. Alternatively, to obtain a structure comprising an MCrAlY coating having a double surface layer in the form of a top layer containing platinum modified aluminide and a sub-surface layer containing aluminides substantially without platinum modification, the platinised coating should be aluminised for a relatively long time of about 6 to 12 hours at the aluminising temperature. This will allow the aluminium to diffuse into the platinised coating further than the platinum has already diffused.

The chrimizing step in the above processes, if performed, is performed essentially to obtain a large gradient of concentration of Cr in and near the surface the MCrAlY coating. This increases its low temperature sulphidation resistance.

An increase in the chromium content of various superalloy coating systems increases their low temperature sulphidation resistance, though an upper limit of about 40 wt. % Cr content is usually adhered to because too high a or content causes excessive brittleness. This low temperature sulphidation resistance is achieved because Cr in the coating oxidises to chromia ($Cr_2O_3$), which is a relatively inert at temperatures below about 750° C. However, above 750° C. chromia dissociates, with the escape from the surface of the coating of $CrO_3$ gas and consequent disruption of the oxide surface scale, leaving the underlying layer open to further corrosive attack. Hence, Cr enrichment of MCrAlY coatings is conventionally understood to be ineffective to increase sulphidation resistance at temperatures above about 750° C.

However, in our invention, we have found that by enriching the Cr content of the MCrAlY coating, preferably up to its maximum advisable limit of about 40 wt. % utilizing the chrimizing step, and thereafter aluminising, optionally platinising (alternatively, and preferably, this optional platinising step can be done before aluminising, which has the effect of increasing the concentration of Al in the resulting layer of platinum modified aluminide), and finally heat treating, we produce a synergistic effect in which the presence of high concentrations of aluminides along with the high concentrations of chromium in the surface layer(s) of the MCrAlY coating changes the reaction kinetics of the chromia at the surface of the coating at temperatures above about 750° C., such that dissociation of chromia encourages the formation of further alumina, which is resistant to corrosive attack at these temperatures.

BRIEF DESCRIPTION OF THE DRAWINGS

Examples of various prior art coatings and coatings according to the invention will now be described with reference to the accompanying figures, in which.

DETAILED DESCRIPTION OF THE INVENTION

Figure 1:
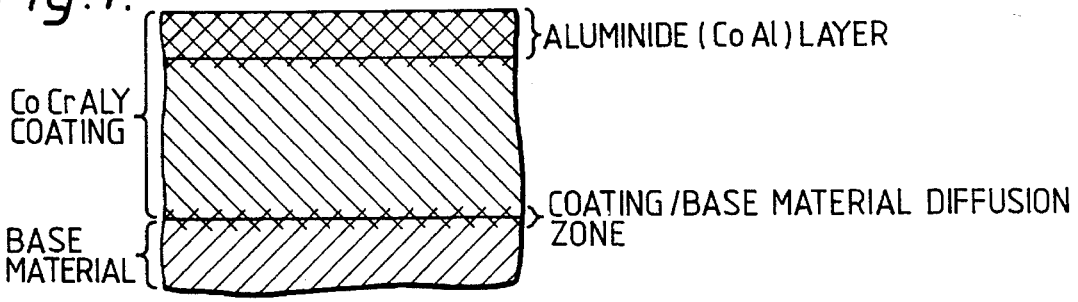
FIG. 1 is a diagrammatic micrograph section indicating the general characteristics of a known aluminised MCrAlY coating.

In tests of the effectiveness of various modifications to the CoCrAlY overlay coating system described above, the overlay coating was first applied to IN738 alloy bars by the previously mentioned argon shrouded plasma spray technique. Extra elements were then introduced into the outer layer of the coating using various methods as described below:

(1) Vapour aluminise at 1090° C. for six hours, then heat treat to restore the properties of the base material, i.e. one to two hours diffusion treatment at 1120° C., gas fan quench, and age 24 hours at 845° C. A diagrammatic representation of the resulting structure is shown in FIG. 1.

Figure 2:
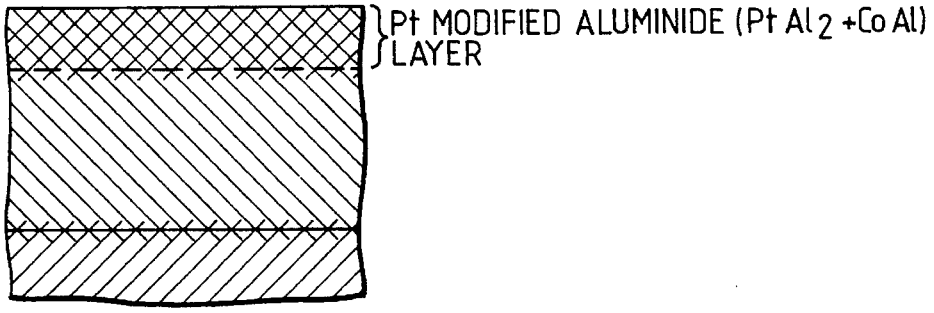
FIGS. 2 and 3 are diagrammatic micrograph sections indicating the general characteristics of two variant coatings according to the present invention.

(2) Vapour aluminise as in (1), clean by controlled blasting procedure, then-platinum plate the coating to a thickness of 15 μm, then heat treat as in (1) to interdiffuse the MCrAlY coating with the Pt layer and restore the properties of the base material. The resulting structure is diagrammatically shown in FIG. 2.

(3) Vapour aluminise as in (1), clean by controlled blasting procedure, then platinum plate the coating to a thickness of 8 μm, then heat treat as in (1) to interdiffuse the MCrAlY coating with the Pt layer and restore the properties of the base material. The resulting structure is diagrammatically shown in FIG. 3.

(4) Vapour chrimize at 1100° C. for five hours in a sealed retort, then additionally process as (2). The resulting structure is as for FIG. 2, except that the aluminide layer is enriched by Cr.

(5) Vapour chrimize at 1100° C. for five hours in a sealed retort, then additionally process as (3). Resulting structure as for FIG. 3, except that the aluminide layers are enriched by Cr.

(6) Vapour chrimize at 1100° C. for five hours in a sealed retort, then additionally process as (1). Resulting structure as for FIG. 1, except that the aluminide layer is enriched by Cr.

In addition to the above six processes involving modification of an initial MCrAlY coating, two further coating systems were tried:

(7) Process as (5), but without an initial MCrAlY base coat.

(8) MCrAlY base coat only.

The major coating processes referred to above are characterised as follows.

The vapour aluminising process took place in an argon-filled retort vessel, with the parts to be aluminised being suspended in close proximity over packs of aluminising powder which liberate aluminium halide gas when heated. Aluminium from the gas is deposited onto the parts and diffuses into it due to the elevated temperature. A commercial example of this technique is the RT69 (trade name) process available from Chromalloy U.K. Limited, of Bramble Way, Clover Nook Industrial Estate, Somercoates, Derby DE55 4RH, England, or its parent company, Chromalloy Research and Technology, Blaisdell, Orangeburg, N.Y. 10962, U.S.A.

Platinum plating was accomplished by an electroplating process, again available from Chromalloy at the sites mentioned above under the trade name RT22.

Vapour chrimizing is performed in a similar way to vapour aluminising and is also available from Chromalloy under the trade name CN70.

The samples processed as outlined above were subjected to simulated isothermal sulphidation tests. The coated test pieces were placed in a Nimonic boat and covered with 50/50 mixture of $Na_2SiO_3$ and $MoS_2$ paste. The samples were then tested at 850° C. in a muffle furnace for times of up to 3550 hours. At intervals a sample of each coating system type was removed and carefully prepared for microscopic examination. The depth of attack was recorded for each test piece. Results of this test are given in FIG. 4, which is a graph of depth of penetration of the coating in microns against time of the test in hours.

Below is a short commentary on the microscopic examinations of the tested samples for each type of coating mentioned in paragraphs 1 to 8 above.

(1) An Al rich outer layer had been produced in the outer part of the MCrAlY coating. Sulphidation attack was observed mainly in the Al rich outer layer, with no attack within the MCrAlY.

(2) A platinum modified aluminide layer ($PtAl_2$+CoAl) had been produced in the outer part of the MCrAlY coating. However, the Al concentration in wt. % within this layer was found to be poor, affording inferior protection against sulphidation attack compared with (1).

(3) A platinum modified aluminide layer ($PtAl_2$+CoAl) had been produced in the outer part of the MCrAlY coating, on top of a cobalt aluminide layer (CoAl). Increased Al concentration in the platinum modified aluminide layer afforded better protection than (2).

(4) A chromium enriched platinum modified aluminide layer ($PtAl_2$+CoAl) had been produced in the outer part of the MCrAlY coating, on top of a chromium enriched MCrAlY coating layer. However, the Al concentration in wt. % within the platinum modified alumina layer was found to be poor, showing only marginally greater protection against sulphidation attack compared with (1).

(5) A chromium enriched platinum modified aluminide layer ($PtAl_2$+CoAl) had been produced in the outer part of the MCrAlY coating, on top of a chromium enriched cobalt aluminide layer (CoAl). Increased Al concentration in the platinum modified aluminide layer afforded better protection than (4).

(6) A chromium enriched aluminide outer layer had been produced in the outer part of the chrimized MCrAlY coating. Sulphidation attack was greater than for (1) due to Al concentration not being sufficiently high, but the presence of additional chromium throughout would improve oxidation protection at lower temperatures.

(7) A chromium enriched aluminide surface layer had been produced on the superalloy specimen. This showed very poor protection against sulphidation, partly due to low Al concentration.

(8) The plain MCrAlY coating exhibited much inferior protection to the aluminised MCrAlY layer of (1), but was better than (7).

Figure 4:
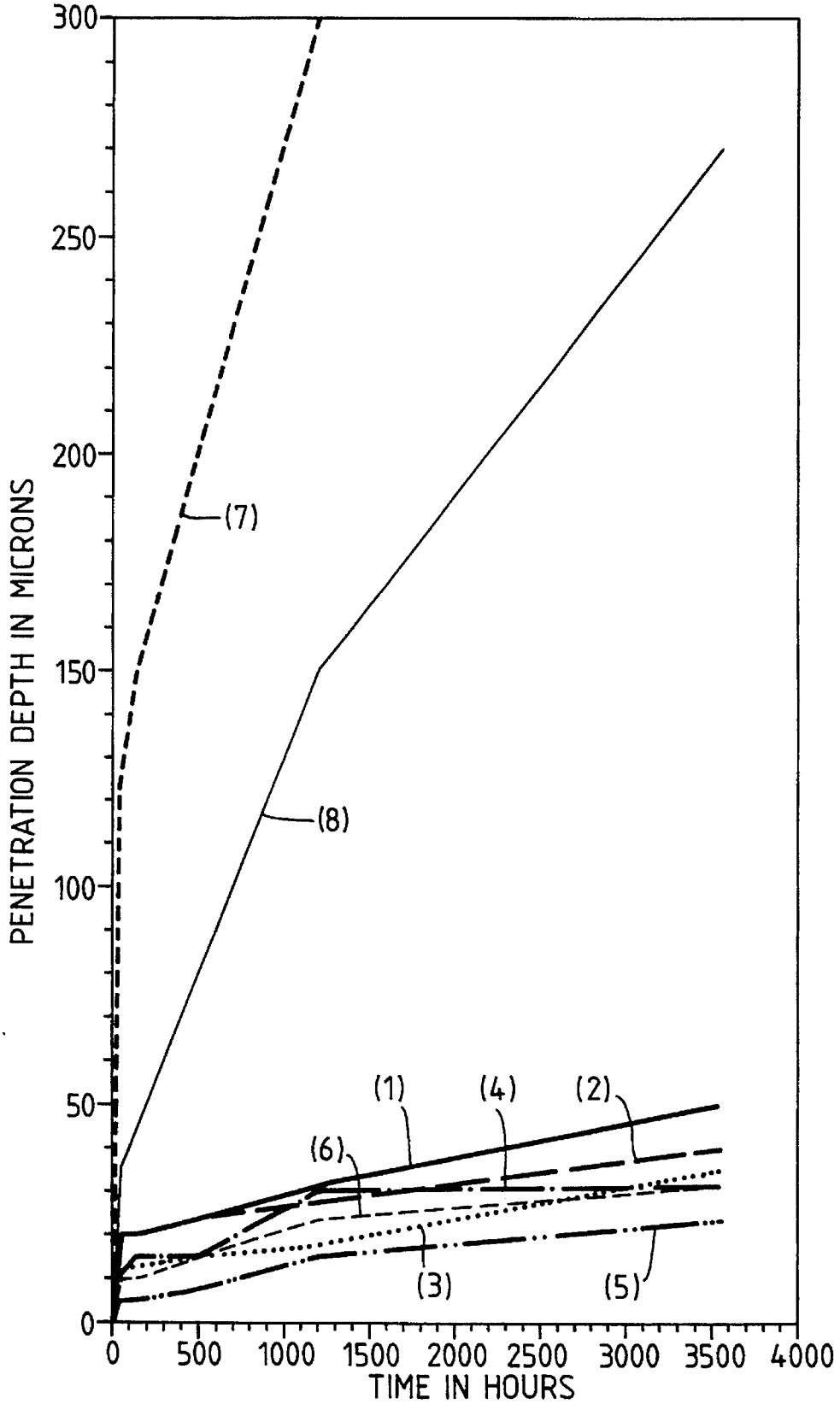
FIG. 4 is a graph showing the effect of sulphidation corrosion on various tested coatings.

As can be seen from FIG. 4, overall best performance in the sulphidation tests was given by coating (5), which had been chrimized, aluminised and platinised with the 8 micron platinum plate diffused layer.

Next best performers were coatings (4), (6), (3) and (2), which were very close together in apparent sulphidation performance. Coating (4) had been processed in the same way as coating (5), except for the application of the thicker 16 micron platinum plate. Coating (6) had been chrimized and aluminised, but not platinised. Coatings (3) and (2) had been aluminised and platinised, but not chrimized.

The trend shown here is that sulphidation performance is increased by the chrimizing step, and increased even further by platinising, provided that aluminium concentrations in the platinum modified aluminide layer can be kept as high as possible. Lower concentrations of aluminium in such cases are associated with application of thicker platinum plate for diffusion.

Figure 5:
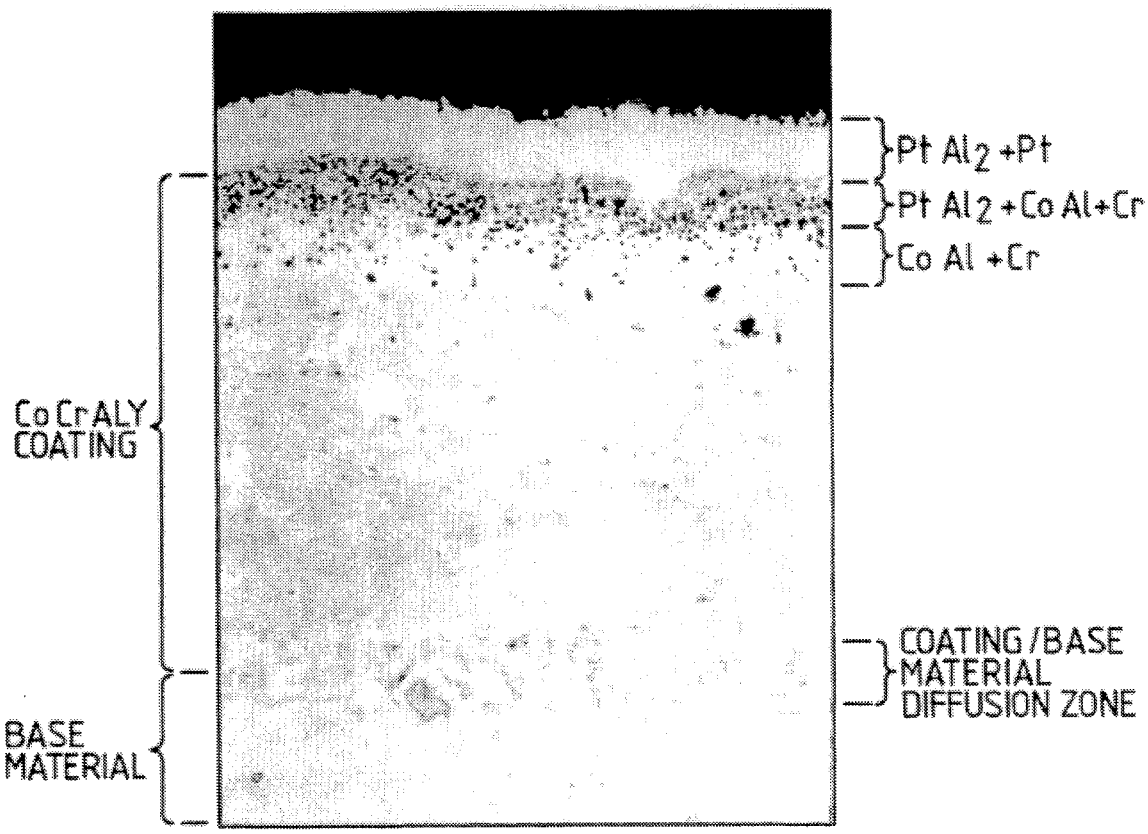
FIG. 5 is a photomicrograph of a section of a preferred coating according to the invention, seen at a magnification of 200X.

FIG. 5 shows a typical microstructure of coating (5) at x200 magnification before sulphidation testing, with the various layers indicated. In accordance with the previous description relating to coating (5), this coating resulted from the following process.

A CoCrAlY overlay coating system on IN738 alloy bars was vapour chrimized at 1100° C. for 5 hours in a sealed retort. It was then vapour aluminised at 1090° C. for 6 hours, cleaned by a controlled blasting procedure, and platinum plated to a thickness of 8 μm. It was next heat treated using one to two hours diffusion treatment at 1120° C., gas fan quench and age 24 hours at 845° C. The heat treatment inter-diffused the processed MCrAlY coating with the Pt layer and restored the properties of the base material. The resulting structure was similar to that diagrammatically shown in FIG. 3, the aluminide layers being additionally enriched by Cr.

Figure 6:
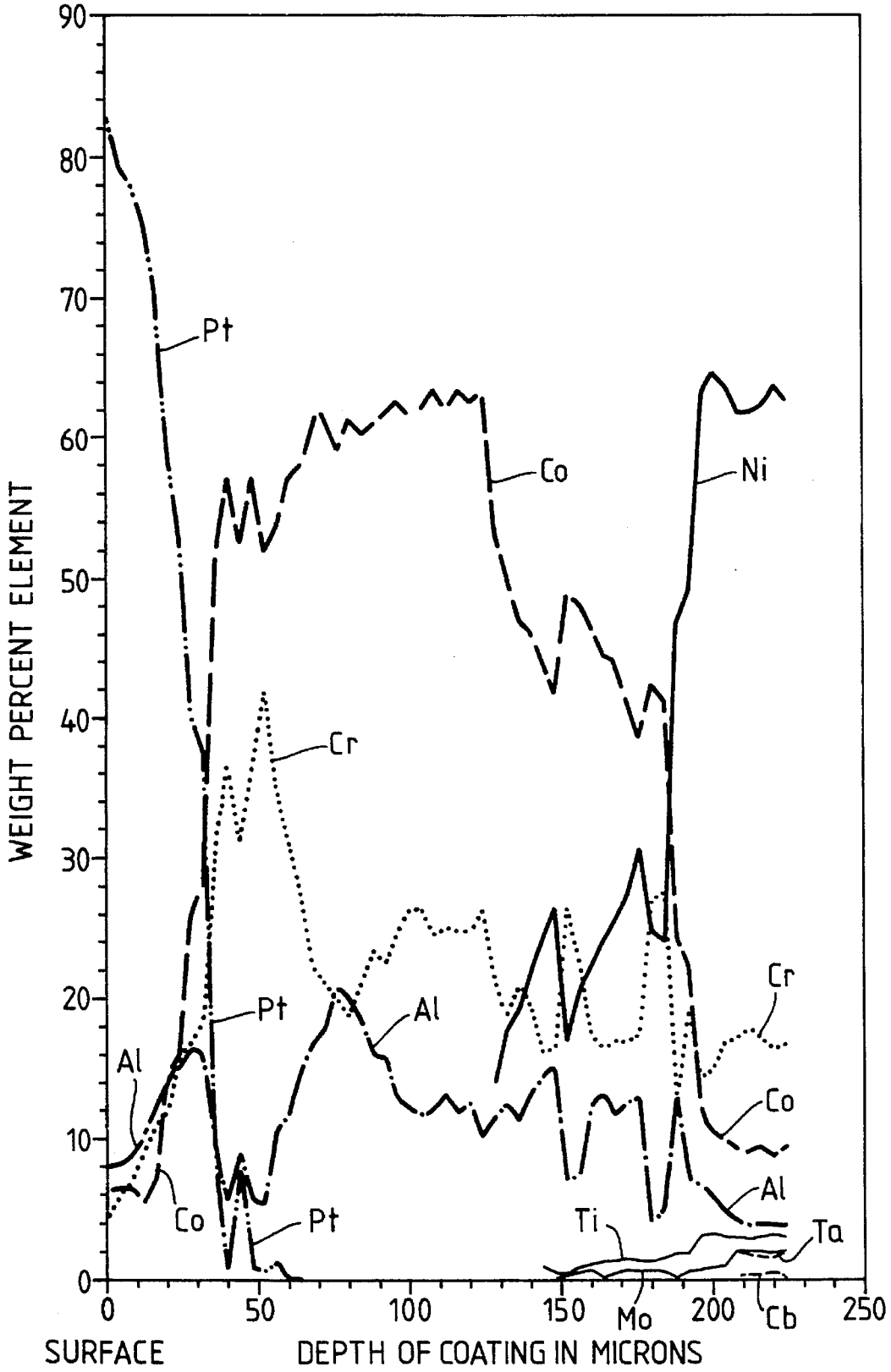
FIG. 6 is a graphical representation of the results of a microprobe analysis of a coating similar to that shown in FIG. 5.

FIG. 6 shows the result of an electron probe microanalysis of a coating similar to that shown in FIG. 5 and produced by the above process. It should be noted that the results of the electron probe microanalysis as plotted are subject to variation due to experimental error and to local variations in element concentrations in the small scale microstructure.

In FIG. 6, the concentration in weight percentage terms of various elements in the coating is graphically plotted against the depth of the coating in microns. Here it can be seen that the Cr content of the coating is up to about 40 wt. % in the chrimized layer, up to about 20 wt. % in the platinum aluminide layer and about 25 wt. % retained in the body of the MCrAlY coating. On the other hand, the highest aluminium content is only about 20 wt. % and is less than this near the surface of the coating in the top platinum modified layer. As expected, a high Pt content is evident in this layer.

Figure 3:
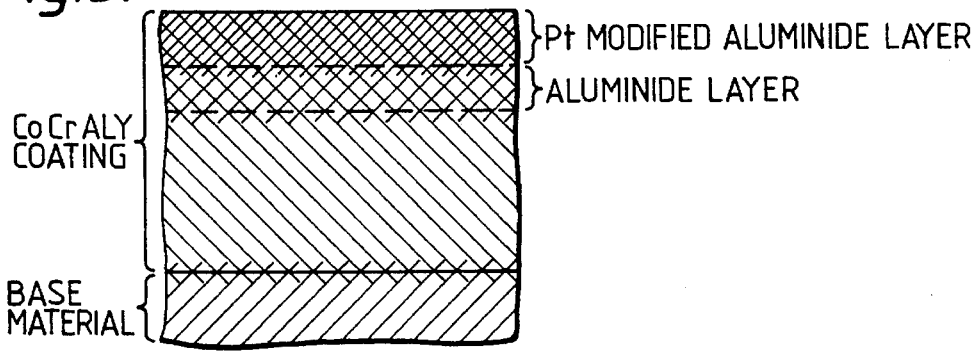

The platinum modified aluminide top layer shown diagrammatically in FIG. 3 and in more detail in FIG. 5, results from diffusion of the deposited Pt plate into the cobalt aluminide surface layer produced by aluminising the MCrAlY overlay earlier in the process. Due to the Pt plating and diffusion process, there will of course be an excess of elemental platinum near the surface of the top layer of the coating, as indicated in FIGS. 5 and 6.

From the work as detailed above it was evident that with coatings (4) and (5) the Al concentration in the outer zones was lower than is generally accepted to be optimum in aluminide coatings. Consequently, further experimental work was undertaken with test pieces in which the process activity and sequence of operation were altered to increase the Al concentration level to 25–30wt. %.

Alterations to the process were essentially to apply the platinum plate directly onto the chrimized MCrAlY overlay coating and platinise by diffusion heat treating at 1050° C. for 2 hours before the aluminising step. Depending upon the depth of the platinum plate as applied and the time for which the platinised coating was subsequently aluminised (thicker platinum modified layers require longer aluminising times), it was found that the structures illustrated in FIGS. 5 and 6 could be reproduced, but with increased Al concentrations of 25–30 wt. % in the aluminide layers.

Figure 7:
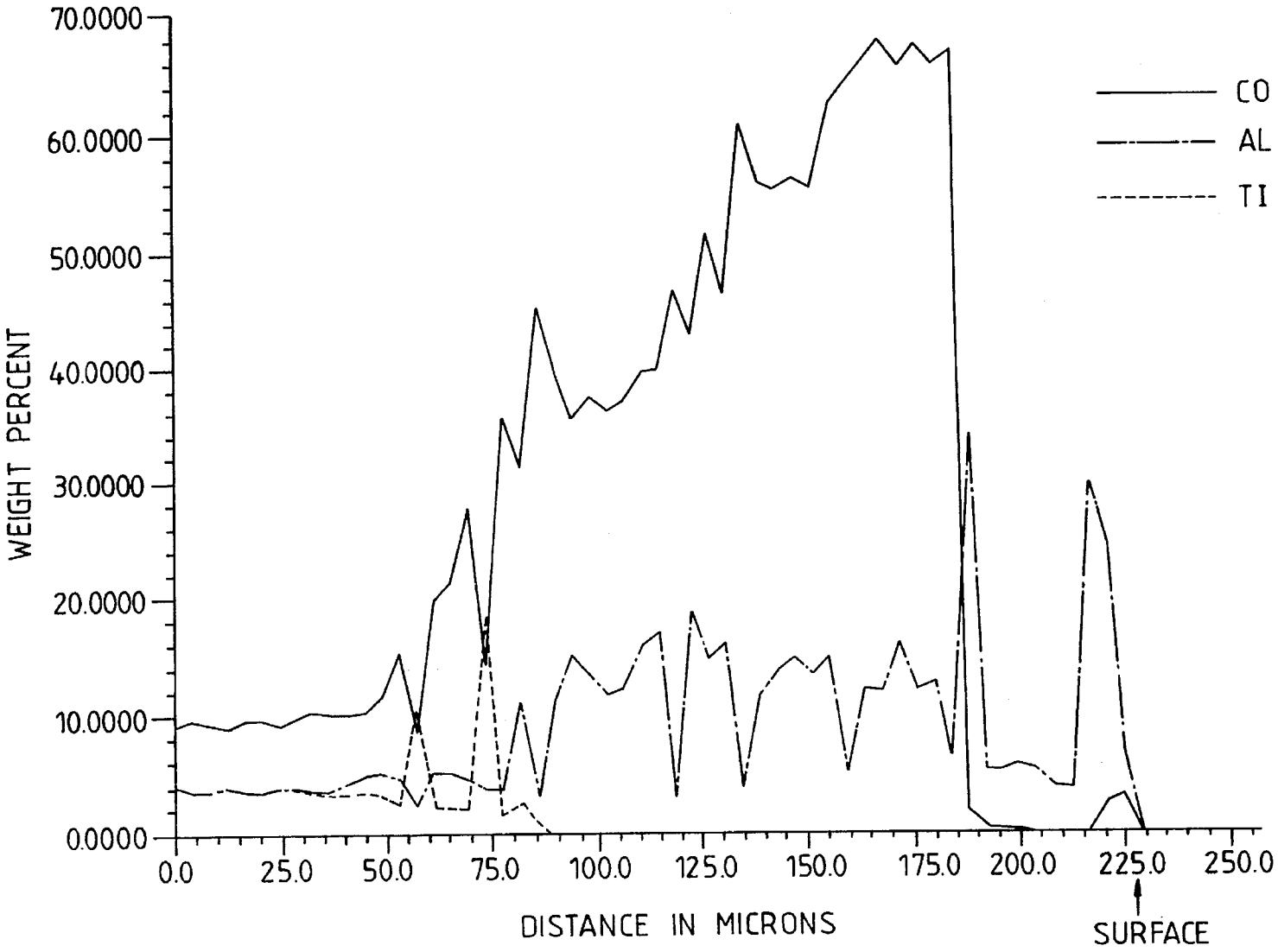
FIGS. 7 and 8 are graphical representations of the results of a microprobe analysis of a further coating similar to that shown in FIG. 5, but made by a different process route.
Figure 8:
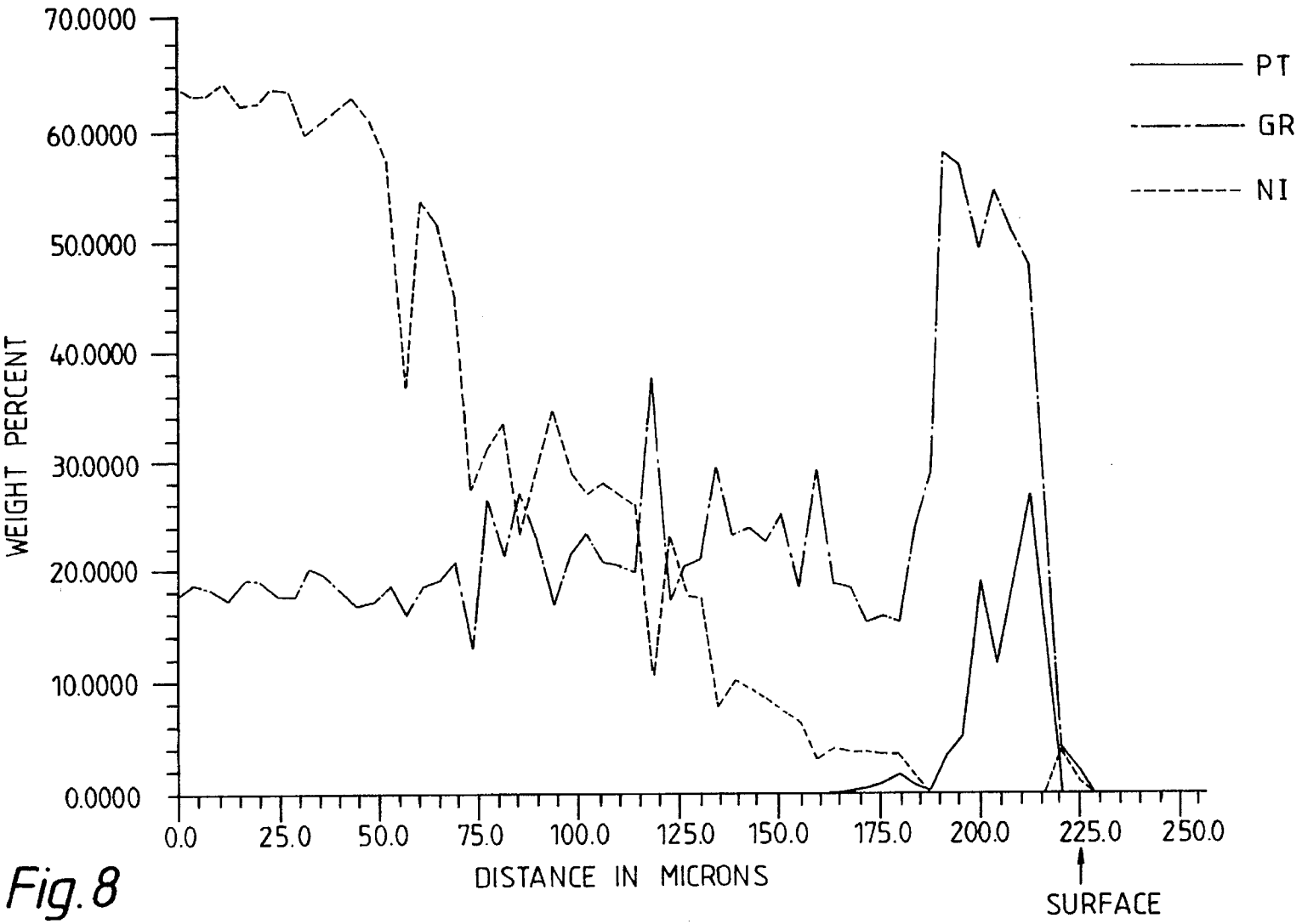

To illustrate the effect of sequentially chrimizing an MCrAlY coating, then platinising and finally aluminising, FIGS. 7 and 8 are electron microprobe plots of elemental abundances in a cross section of a coating produced in this way. As in FIG. 6, the concentration in weight percentage terms of various elements in the coating is graphically plotted against the depth of the coating in microns. However, it is important to notice that whereas in FIG. 6 the coating depth in microns is measured from a zero datum at the surface of the coating, in FIGS. 7 and 8, the zero datum is within the superalloy base material, the surface of the coating being at approximately 225 μm on the horizontal scale.

It can be seen from FIG. 7 that the Al content of the coating in the outer platinum aluminide layer is up to about 30 wt. %, as desired. As shown in FIG. 8, there is also up to about 30 wt. % chromium in the platinum aluminide layer, a very high Cr content of between about 30 and 60 wt. % in the chrimized layer comprising the subsurface layer of the coating, and an average of about 25; wt. % Cr retained in the body of the MCrAlY coating. There is a second peak of about 34 wt. % aluminium concentration just below the chrimized layer at about the 190 μm mark on the horizontal scale. It will also be seen that the cobalt concentration increases very abruptly at about the same depth into the coating. These characteristics of the plots for Al and Co illustrate that the chrimized layer acts as a barrier for the outward diffusion of these species from the MCrAlY overlay during the heat treatment associated with platinising and aluminising.

The plot of Cr concentration in FIG. 8 shows peaks well in excess of the 40 wt. % usually considered desirable for chrimized coatings in view of the previously mentioned embrittlement associated with high Cr concentrations. However, this is not considered to be a problem for the production of commercially valuable coatings by the above process sequence, because the level of chromium enrichment of the MCrAlY overlay during chrimizing can be readily controlled by varying the process parameters, such as time and temperature, as is well known in the industry.

In summary, the further experimental process work, concerned with platinising before aluminising, showed that Al concentration in the outermost platinum aluminide layer of the coating could be increased by an advantageous amount, compared with the previously described process involving platinising after aluminising. Such increased aluminium concentration enables achievement of the required synergistic effect of extra alumina scale production at the surface of the coating at high temperatures consequent upon dissociation of chromia, thereby enhancing high temperature sulphidation resistance.

Although of maximum advantage when utilized in conjunction with the chrimizing step, the method of platinising an MCrAlY coating before aluminising it, in order to gain higher Al concentrations in the platinum modified aluminide surface layer of the finished coating, will also plainly be advantageous when utilized without the prior chrimizing step.

Whereas the above description has concentrated on the use of a CoCrAlY overlay coating on an IN738 nickel based superalloy substrate, the invention is plainly more generally applicable to MCrAlY-type coatings on a variety of superalloy substrates.

I claim:

1. A process for providing an M-based superalloy base material, where M is at least one of iron, cobalt and nickel, with a multiplex protective coating system containing aluminides in and near its surface, the process comprising the steps of:

applying an MCrAlY alloy coating to the surface of the base material, the Al content of the coating being in the range 4 to 20 weight percent;

chromizing the MCrAlY coating to produce a coating with a chromized top layer having a chromium content of not more than about 40 weight percent;

aluminizing the chromized coating to produce a coating having a surface layer containing aluminides of the M constituent of the coating;

depositing a platinum layer onto the surface of the aluminized coating, and heating the resulting coating to diffuse the platinum layer into the underlying aluminide containing layer, thereby to produce an MCrAlY coating having a platinum modified aluminide surface layer.

2. A process for providing an M-based superalloy base material, where M is at least one of iron, cobalt and nickel, with a multiplex protective coating system containing aluminides in and near its surface, the process comprising the steps of:

applying an MCrAlY alloy coating to the surface of the base material, the Al content of the coating being in the range 4 to 20 weight percent;

aluminizing the MCrAlY alloy coating to produce a coating having a surface layer containing aluminides of the M constituent of the coating;

depositing a platinum layer onto the surface of the aluminized coating, and heating the resulting coating to diffuse the platinum layer into the underlying aluminide containing layer, thereby to produce a HCrAlY coating having a platinum modified aluminide surface layer.

3. A process according to claim 1 or claim 2, in which the platinum layer is applied to a thickness of 5 to 15 μm.

4. A process according to claim 1 or claim 2, in which the thickness of the applied platinum layer and the subsequent heat treatment are such that during heat treatment the platinum and the underlying aluminides interdiffuse completely to give a coating structure comprising an MCrAlY coating having a single surface layer comprising platinum modified aluminide.

5. A process according to claim 1 or claim 2, in which the thickness of the applied platinum layer and the subsequent heat treatment are such that during heat treatment the platinum and the underlying aluminides do not inter-diffuse completely, thereby giving a coating structure comprising an MCrAlY coating having a double layer structure of a top layer containing platinum modified aluminide and a subsurface layer containing aluminides substantially unmodified by platinum.

6. A process according to claim 1 or claim 2, in which the platinum diffusing heat treatment is utilized to restore the properties of the base material after the aluminizing step.

* * * * *